US008221044B2

(12) United States Patent
Bourdelain

(10) Patent No.: US 8,221,044 B2
(45) Date of Patent: Jul. 17, 2012

(54) SYSTEM FOR AUTOMATICALLY PRODUCING A BOUND ALBUM CONSISTING OF INDIVIDUAL SHEETS, ESPECIALLY A PHOTO ALBUM

(75) Inventor: Laurent Bourdelain, Revel (FR)

(73) Assignee: Photo Me Holding France, Echirolles (FR)

( * ) Notice: Subject to any disclaimer, the term of this patent is extended or adjusted under 35 U.S.C. 154(b) by 372 days.

(21) Appl. No.: 12/456,536

(22) Filed: Jun. 18, 2009

(65) Prior Publication Data

US 2009/0324365 A1 Dec. 31, 2009

(30) Foreign Application Priority Data

Jun. 30, 2008 (FR) ..... 08 54419

(51) Int. Cl.

| | |
|---|---|
| ***B42C 11/00*** | (2006.01) |
| ***B42C 9/00*** | (2006.01) |
| ***B42C 13/00*** | (2006.01) |
| ***B42C 5/00*** | (2006.01) |
| ***B42B 5/00*** | (2006.01) |
| ***B42B 9/00*** | (2006.01) |

(52) U.S. Cl. ..... 412/18; 412/1; 412/6; 412/8; 412/9; 412/11; 412/16; 412/25; 412/32; 412/33; 412/37

(58) Field of Classification Search ..... 412/1, 6, 412/8, 9, 16, 18, 25, 32, 33, 37, 901, 11
See application file for complete search history.

(56) References Cited

U.S. PATENT DOCUMENTS

| | | | | |
|---|---|---|---|---|
| 3,101,493 | A * | 8/1963 | Jorgen | 412/11 |
| 6,506,008 | B2 * | 1/2003 | Merkli | 412/1 |
| 2008/0031707 | A1 * | 2/2008 | Bourdelain et al. | 412/33 |
| 2003/0086773 | A1 | 5/2008 | Lawton | |

FOREIGN PATENT DOCUMENTS

| | | |
|---|---|---|
| EP | 1886831 A | 2/2008 |
| FR | 2 904 579 | 2/2008 |

OTHER PUBLICATIONS

Berger P. "Investieren Mit Blick Auf Digitale Nischenprodukte", vol. 34, No. 35, Sep. 17, 1998.

* cited by examiner

*Primary Examiner* — Edward Tolan
*Assistant Examiner* — Justin V Lewis
(74) *Attorney, Agent, or Firm* — Wolf, Greenfield & Sack, P.C.

(57) ABSTRACT

A system for automatically producing a bound album consisting of individual sheets, for example, a photo album is disclosed. The system includes a unit which immediately draws in sheets output by a printer or a stacker; a unit for creasing said sheets so as to facilitate folding them and keeping said sheets in their folded form; an adhesive application unit designed to paste at least some of the sheets two by two; and a unit to flip part of the cover sheet. The sheets are received and compiled on a delivery board equipped with registration features for this purpose. The board is capable of translational movement in a direction substantially parallel to the direction in which the sheets are transported inside the system and movement between several positions in synchronism with the adhesive application unit.

9 Claims, 13 Drawing Sheets

SYSTEM FOR AUTOMATICALLY PRODUCING A BOUND ALBUM CONSISTING OF INDIVIDUAL SHEETS, ESPECIALLY A PHOTO ALBUM

FIELD

A system designed to allow the automatic production, i.e. without any intervention by an operator or user, of an album, especially a photo album, comprising a plurality of sheets attached to each other and articulated by one of their edges so as to constitute a binding is disclosed.

A user can use a thermal printer to print various negatives produced by digital photography and produce a corresponding photo album immediately.

DESCRIPTION OF THE PRIOR ART

Currently and usually, if a user wants to make a compilation of photos (regardless whether they are of analog or digital origin) on the basis of specific topics or events, the user has the option of sticking or inserting the photos in question into a conventional album comprising a plurality of rigid sheets assembled together by a hinge. Each sheet is associated with a transparent flap made of plastic film which is used to position the photos as the user wishes. This type of album is heavy and bulky and therefore does not make it possible to have a number of albums, one for each of the themes of the photos in question.

Given the massive increase in the availability of digital photos, users are increasingly demanding topic-based albums of appropriate dimensions, especially in terms of their thickness, i.e. thickness depending on the number of prints.

A semi-automatic device which already makes it easier to produce such an album is described in Document FR 2 904 579. Basically, this device comprises:

- a unit for folding sheets in order to configure them to the desired format;
- a unit for creasing said sheets so as to facilitate folding them and keeping said sheets in their folded form;
- an adhesive application unit designed to paste at least some of the sheets two by two after folding;
- and a delivery board to receive the creased sheets and to compile said sheets in order to produce an album, said delivery board being capable of translational movement parallel to the direction in which said sheets are transported inside the device and moving between several positions in synchronism with operation of the folding unit.

Although this device undeniably represents significant progress in the production of photo albums, especially digital photos, it does, however, have the following drawbacks.

Firstly, after the album has been produced, it must be picked up from the board by an operator before using a trimmer to clean it up because the various sheets are not perfectly aligned during compilation. This prevents continuous automatic production of several albums without any operator intervention.

Also, the adhesive application unit used, although it can be retracted out of said described device, is relatively awkward to handle because of its design.

In addition, this device is relatively bulky and heavy and this poses problems for some potential users.

SUMMARY

In one aspect, a system is provided for producing such an album which is fully automatic to the extent that, firstly, prints printed, for example, by a thermal printer are immediately drawn into the system itself, without any intervention of an operator or user, and to the extent that said system comprises a built-in trimmer and a unit which ejects the album after completion and cutting.

A system for automatically producing a bound album comprising individual sheets—intermediate sheets and cover sheets respectively is disclosed. In one embodiment, this system comprises:

- a unit which immediately draws in sheets output by a thermal or inkjet printer or a stacker;
- a unit for creasing said sheets so as to facilitate folding them and keeping said sheets in their folded form;
- an adhesive application unit designed to paste at least some of the sheets two by two;
- a unit to flip part of the cover sheet;

said sheets being received and compiled on a delivery board equipped with registration features for this purpose, said board being capable of translational movement in a direction substantially parallel to the direction in which the sheets are transported inside the system and moving between several positions in synchronism, in particular, with the adhesive application unit.

In one embodiment, the unit for flipping the cover sheet comprises a substantially curved arm which is articulated on the housing of the system and designed to move between at least two extreme positions respectively, a lower or bottom position suitable for receiving the upstream part of the cover sheet and an upper or top position intended to cause, in particular, folding of the upstream part of the cover sheet over the other intermediate sheets. This articulated arm is moved between its two extreme positions by means of a motorized cam and its end which is opposite to its hinge pin has an idler roller capable of cooperating with some of the rollers which transport the sheets inside the system.

Advantageously, the system is provided with a built-in trimmer designed to ensure clean cutting of the free edges of the sheets that make up the album after the latter has been produced, said album being transferred to the operational area of said trimmer by the delivery board. This ensures greater safety by eliminating any hazardous manipulation.

The system is also advantageously equipped with an ejection mechanism which ensures ejection of the album after finishing by the trimmer at the level of a box or receptacle from where the album can be removed by the user.

In one embodiment, the creasing unit comprises a punch and a die between which the sheets are capable of passing one by one, except during the actual creasing step itself, said punch being mounted on the end of an articulated arm which is moved by a cam that is directly actuated by the motor shaft, the die being fitted with a movable pressure pad suitable for facilitating ejection of the fold of the sheet made in its body as a result of the action of the punch and preventing said sheet from catching against the edge of the die.

In one embodiment, the adhesive application unit comprises:

- a storage spool for a backing covered in a film of transfer adhesive;
- a storage spool for the backing alone after depositing the transfer adhesive;
- an adhesive motor roller driven by a specific motor capable of rotating in two directions which ensures unwinding of said backing complete with its adhesive film;
- a pasting roller designed to come into contact with the sheet or part of a sheet to be pasted and cooperating with the adhesive motor roller by meshing with the latter, said pasting roller being rotatably mounted, i.e. capable of rotating freely in only one direction, at the end of a lever which is articulated on the housing and held in its operational adhesive application position by a spring attached to the housing of the system;

a pasting contact roller which counteracts the action of the pasting roller during actual pasting phases.

Advantageously, the adhesive application unit also comprises a handle connected to said lever and designed to allow at least partial retraction of the active pasting components in order to make it possible to perform the adhesive refilling and maintenance operations required by this unit.

In addition, said board is fitted on height-adjustable guide rails which are mounted for this purpose on cross pieces which are articulated on the housing of the system in order to keep the height of the upper sheet of the album which is being made up substantially constant regardless of the number of sheets which the album comprises, said rails being fitted for this purpose with an elastic return mechanism connected to the housing and causing the board to be pulled back against the limit stops consisting of at least one presser roll.

BRIEF DESCRIPTION OF THE DRAWINGS

The way in which the invention may be implemented, its operating principle and resulting advantages will be made more readily understandable by the description of the following embodiments, given merely by way of example, reference being made to the accompanying drawings.

DETAILED DESCRIPTION

Figure 2:
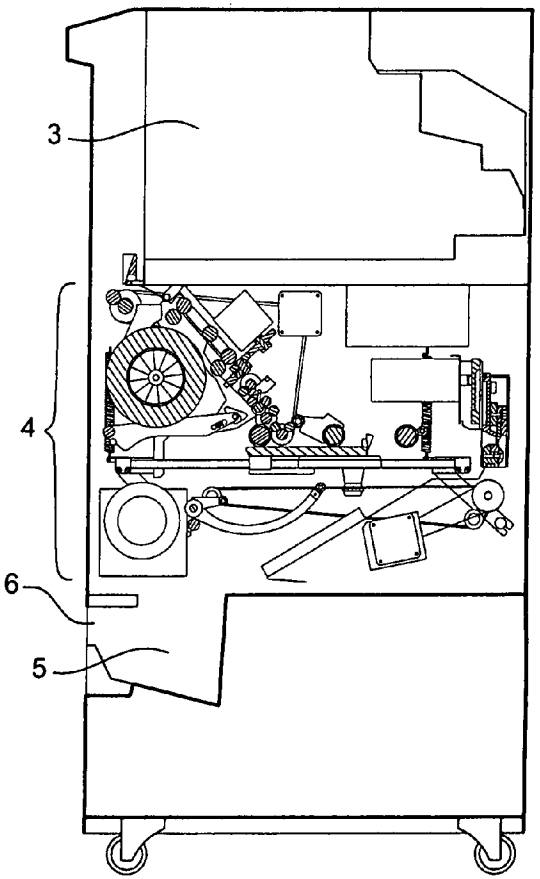
FIG. 2 is a schematic sagittal cross-sectional view of the system of FIG. 1.
Figure 1:
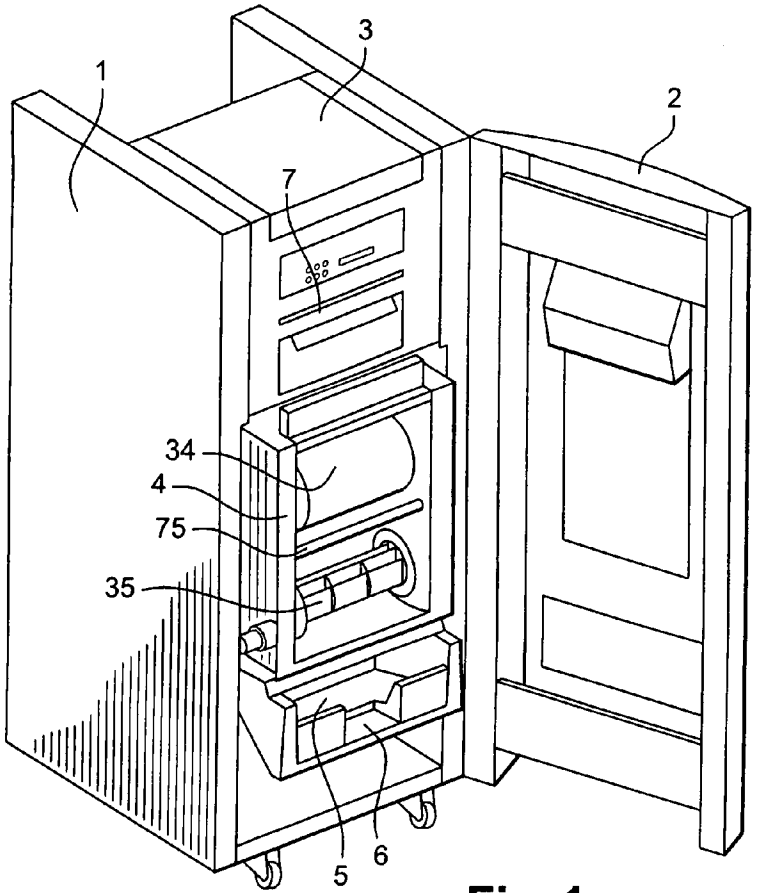
FIG. 1 is a schematic perspective view of a complete system, i.e. including the thermal printer for producing the sheets, in accordance with the one embodiment.

A general view of the system according to an embodiment is shown in FIGS. 1 and 2. The system is very compact insofar as a single housing 1 accommodates firstly a thermal printer 3 (for instance a 8"×12" format printer marketed under the name SHINKO SHS-1245) designed to print negatives obtained by digital photography, said negatives being assembled by album composition software or any other software, said printer being connected to a PC (not shown) and, underneath printer 3, a functional unit 4 capable of ensuring actual production of a digital photo album.

Reference 7 denotes the output of prints obtained from the printer, said prints then being drawn in by functional unit 4 as described below in greater detail.

In one variant (not shown), thermal printer 3 is replaced by a stacker, i.e. a stack of previously produced negatives or by any other type of printer, especially an inkjet printer.

Underneath functional unit 4 there is a receptacle 5 for albums produced by the functional unit, access 6 also being provided to enable the user to remove the album(s) stored inside receptacle 5.

This assembly can be accessed via door 2 which is articulated on housing 1, thus making it possible to carry out system maintenance and, more especially and advantageously, at the same time replace the consumable for printer 3 and the consumable for the adhesive application unit as described later on in greater detail. The compactness of the system and the ease with which such a system can be maintained are readily apparent.

Figure 3:
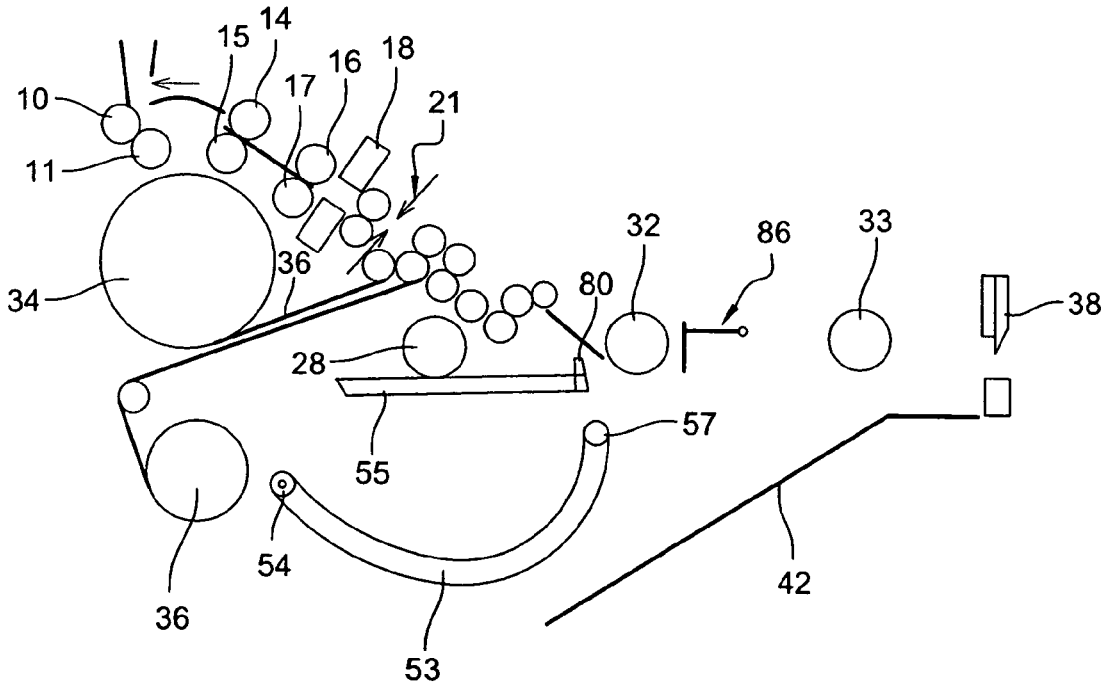
FIG. 3 is a simplified schematic view showing the essential components of the functional unit which is shown in greater detail in FIG. 4.
Figure 4:
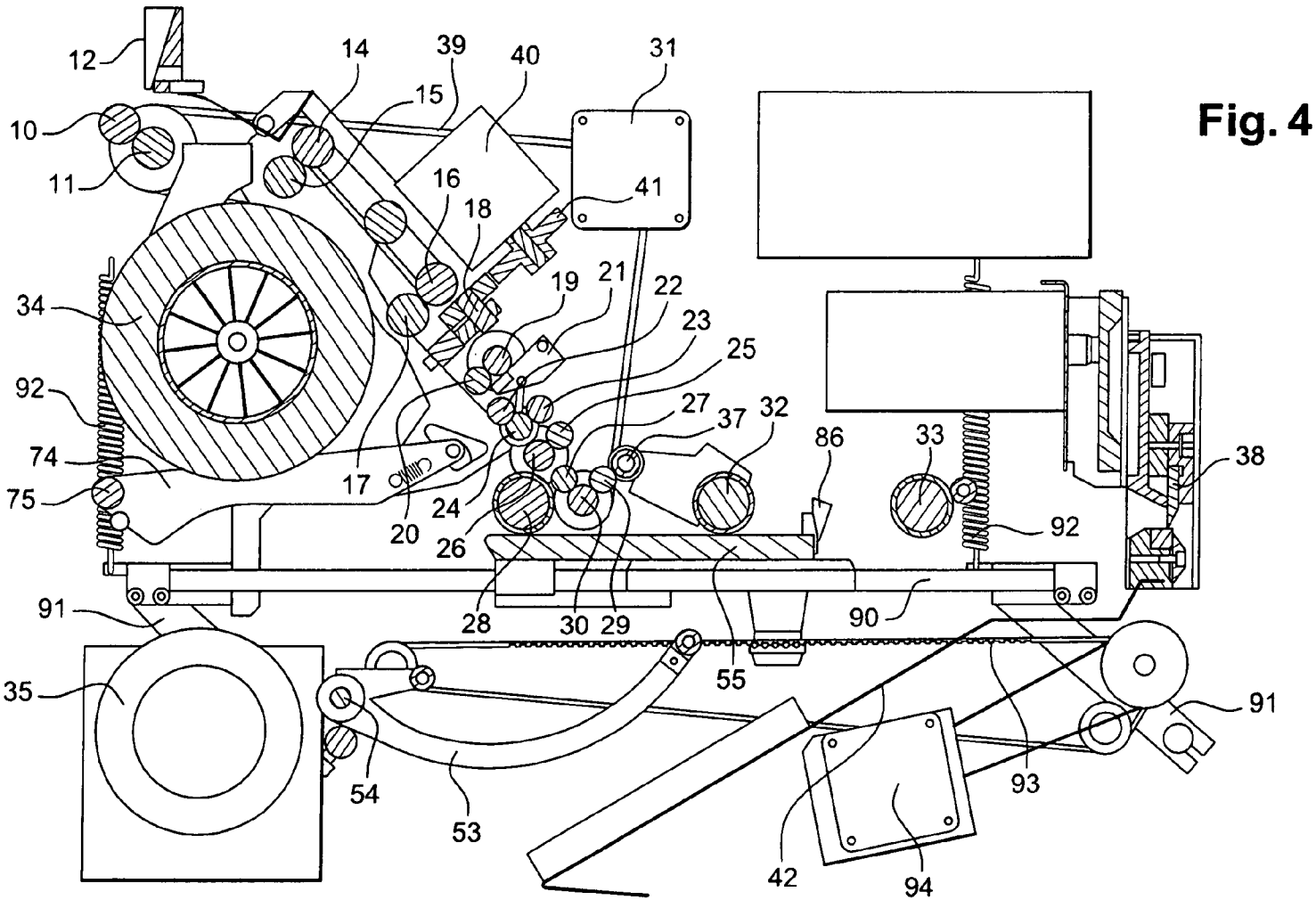

FIGS. 3 and 4 show the actual functional unit 4 in greater detail. As apparent in FIG. 4 in particular, functional unit 4 comprises a number of rollers which fulfill various functions, especially transporting the sheets output by printer 3, as well as counter pressure functions (especially during the pasting phase) and presser rolls used to ensure the cohesion and integrity of the actual album itself.

Rollers 11, 15, 17, 19, 26 and 30 are all motor driven and actuated via toothed belt 39 which is rotationally driven by electric motor 31.

As already stated, the system also comprises presser rolls 28, 32 and 33 respectively which are idler rollers designed to exert pressure on the album as it is being assembled as described later on in greater detail.

Rollers 10, 14, 16, 20, 25, 29 shown in FIGS. 3 and 4 are idler rollers or simply mesh with the roller against which they are kept pressed. Roller 27 is merely used as a guide: it is an idler roller. The rollers which are specific to the adhesive application unit (22, 23 and 24) are also specifically described later on.

The peripheral surfaces of these various rollers are provided either with a layer of foam or a layer of silicone, depending whether they are intended to adhere to the unpasted sheet or, on the contrary, are intended to prevent any kind of adhesion when they come in contact with sheets which have been pasted.

The various steps involved in producing an album in accordance with one embodiment will now be described in order to make the operation and structure of functional unit 4 more easily understandable.

FIGS. 10*a* to 10*d* show the various steps in which all the sheets which constitute the album are fed into the functional unit and the first phases in which said sheets are transported inside functional unit 4.

Sheet 50 output by printer 3 is guided by appropriate deflectors (not shown) near two input rollers 10 and 11 of the functional unit. Insertion of sheet 50 in this area is also detected by sensor 12 which consists of a photoelectric cell which activates motor 31 and consequently rotation of the rollers which belong to the first motor group.

The detected sheet is drawn in by two rollers (10 and 11) and this moves it downwards into the posterior area of functional unit 4. Once the entire sheet has been drawn in by the two rollers 10 and 11, sensor 12 triggers reversal of the direction of rotation of motor 31 in order to produce upward movement of said sheet 50. The sheet cooperates with a deflector 51 which orients it in the direction of two pairs of flattener rollers, 14, 15 and 16, 17 respectively, which transport it inside the functional unit. Said sheet 50 is detected (FIG. 10*c*) by another sensor 21 which consists of a fork sensor which makes it possible to ensure subsequent processing of the sheet with all the required accuracy insofar as it accurately determines the leading edge of said sheet and consequently the precise position of the sheet, by counting the number of steps made by stepper motor 31. When the sheet is in a suitable position, this causes actuation of creasing unit 18 which, depending on the nature of the sheet, triggers making a single crease (intermediate sheet) or four creases (cover sheet).

Figure 5:
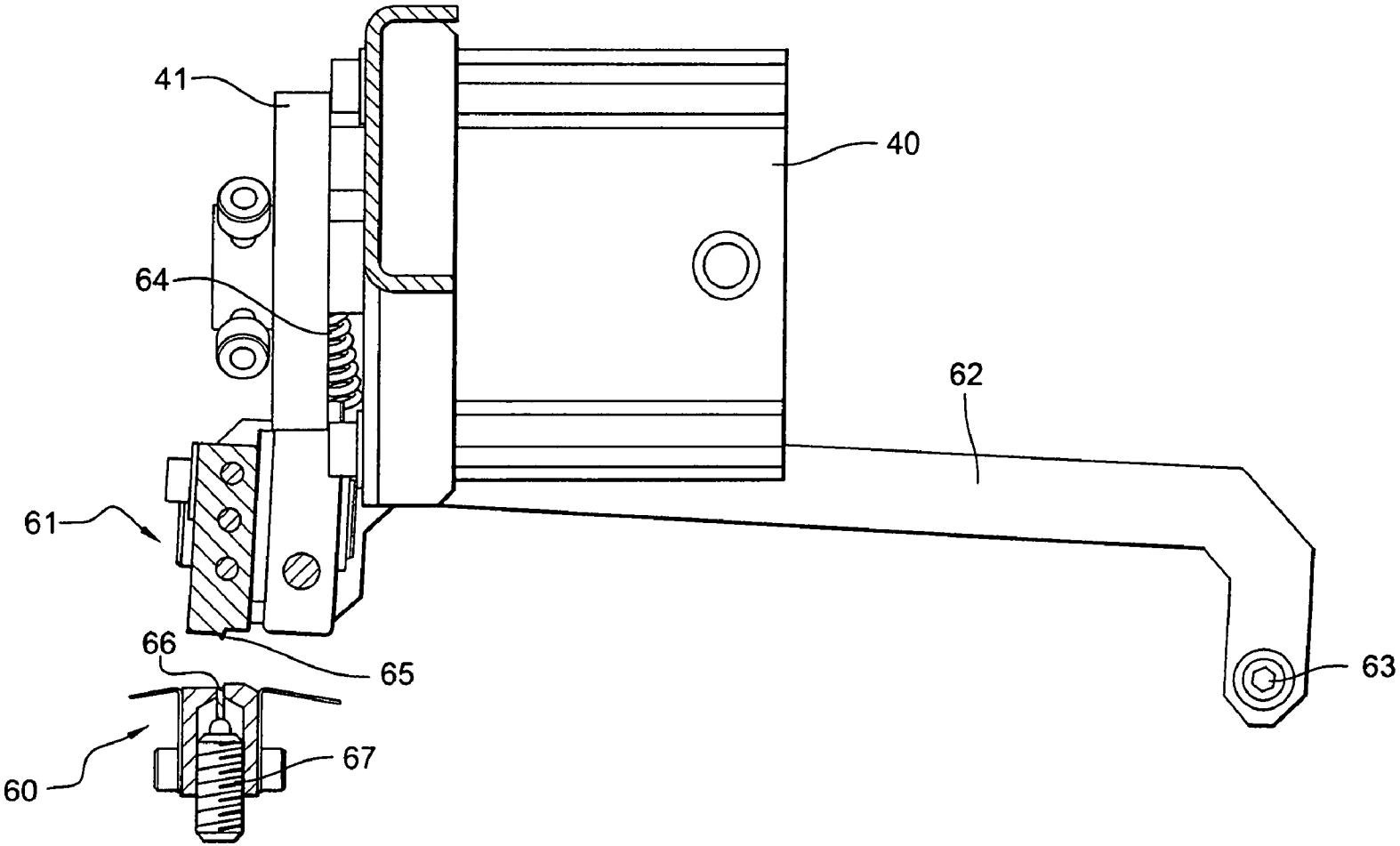
FIG. 5 is a schematic view intended to show the creasing unit in accordance with one embodiment.

This creasing unit is also described in relation to FIG. 5. This unit comprises a die 60 and a punch 61 designed to cooperate with the latter, said punch being mounted on the end of an arm 62 articulated on the housing of functional unit 4 at 63 and held in its non-operational position by means of spring 64 attached to said housing. In a known manner, the punch is equipped with a protruding linear area 65 capable of cooperating with a slit 66 made in die 60 in order to ensure creasing of the sheet which passes between the punch and the slit.

Advantageously, said die 60 has a movable pressure pad. To achieve this, it comprises an ejector which occupies slit 66, said ejector being pushed back upwards by two spring plungers 67 which cause ejection of the crease made in the sheet thanks to cooperation between area 65 of the punch and slit 66 of the die, thus preventing the sheet from catching against the lip of said slit when the sheet starts moving again.

Punch 61 is actuated in cooperation with die 60 by means of a cam 41 which is directly coupled to the motor shaft of motor 40. Obviously, the sheet is stationary during the creasing operation because the rollers which transport it are stopped. After the creasing operation, transport of the sheets continues.

The specific processing of the cover sheet has been described in relation to FIGS. 11*a* to 11*d*. This is the first sheet of the album which is processed, i.e. the first sheet output by the printer in order to produce the album in question. After the creasing step, said cover sheet 52 is received on a so-called cover arm 53 which has a substantially curved or arched shape in order to encourage bending of said sheet as is apparent in FIG. 11*a* in particular.

Figure 7A:
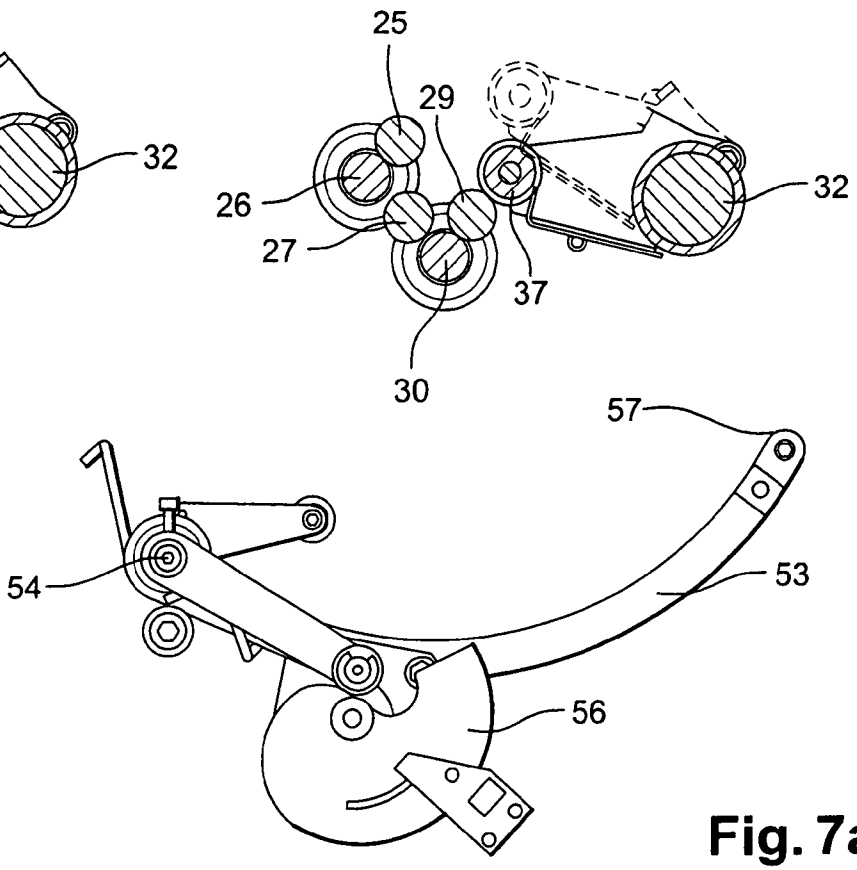
FIGS. 7*a* and 7*b* respectively show the articulated arm designed to enable special processing of the sheet which constitutes the cover of the album produced by the system in accordance with one embodiment in its lower and upper opposition.
Figure 7B:
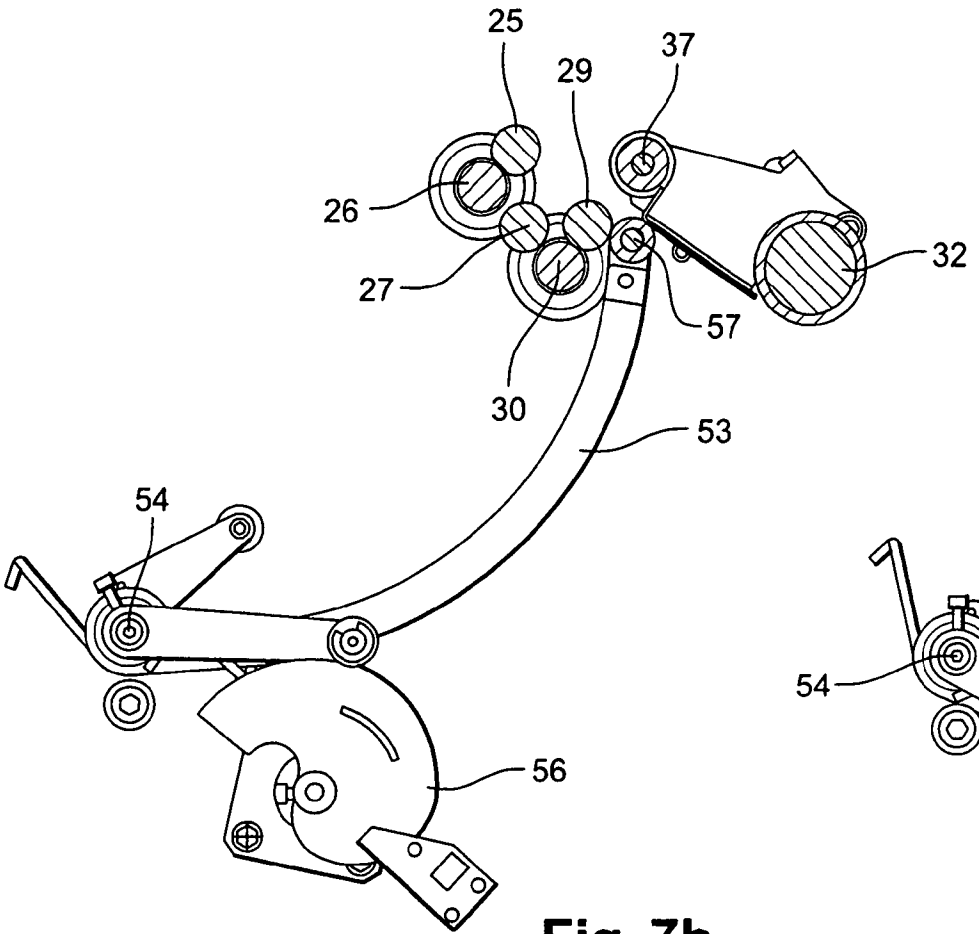

This cover arm 53 is shown in greater detail in FIGS. 7*a* and 7*b*. One of its ends is articulated at 54 on the housing of functional unit 4 and it is actuated by means of cam 56 in order to enable it to be positioned in two operational positions respectively:

- a lower position shown in FIG. 7*a* which makes it possible to clear access to a delivery board 55 on which the album will be positioned and shaped,
- and an upper position intended firstly to make it possible to position the flap of said cover and secondly to effectively place said flap on the stack consisting of intermediate sheets after they have been positioned and pasted two by two.

To achieve this, the free end of arm 53 has an idler roller 57 located so that it can cooperate with a third pair of drop rollers 29 and 30 in order to lift the flap of the cover and push roller 37 upwards, thereby releasing the clearance necessary to raise the flap.

Figure 11A:
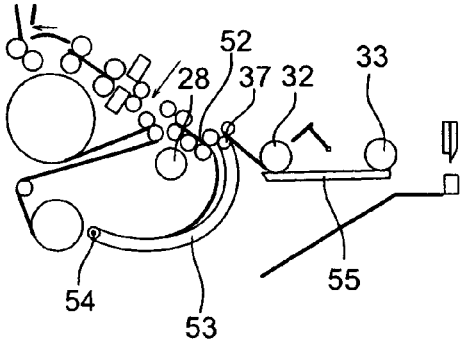
FIGS. 11*a* to 11*d* schematically show the special path taken by the sheet which constitutes the cover of the album after the previous steps.
Figure 11B:
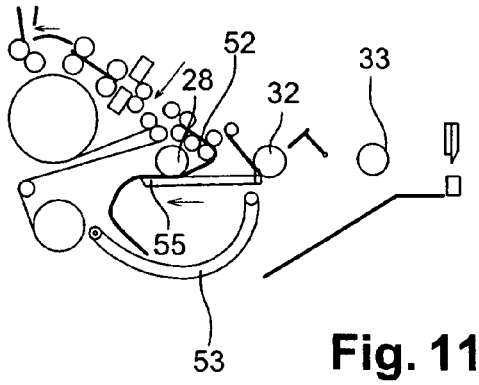
Figure 11C:
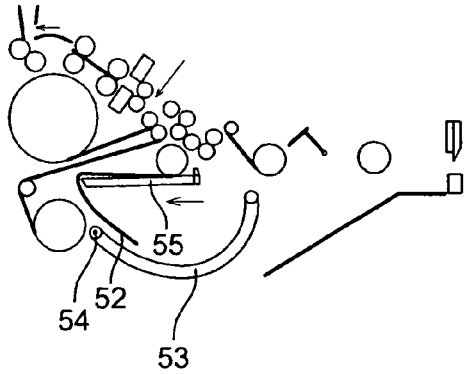

Thus, in FIG. 11*a*, cover arm 53 is in its upper position. This being so, the first part or upstream part of cover sheet 52 is received on said arm and bends substantially parallel to the curve of arm 53. After storage of this upstream part of cover sheet 52 on arm 53, the latter drops into its lower position (FIG. 11*b*) due to the action of cam 56 and delivery board 55 is translated to its sheet positioning and reception position. Consequently, this causes cooperation between rear presser roll 28 and said board 55, thus tensioning the downstream area of cover sheet 52 and then flattening it against said board. FIG. 11*c* shows flattening of the downstream area of cover sheet 52 against board 55 by said rear presser roll 28.

Figure 11D:
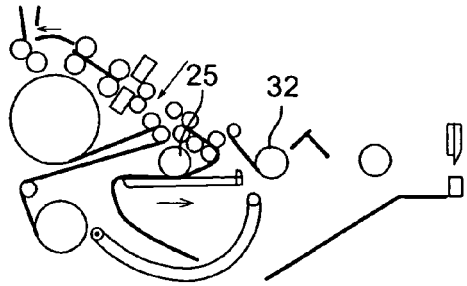

Following this flattening, board 55 is translated in the other direction in order to move it into position in order to receive the other intermediate sheets (FIG. 11*d*).

Figure 12A:
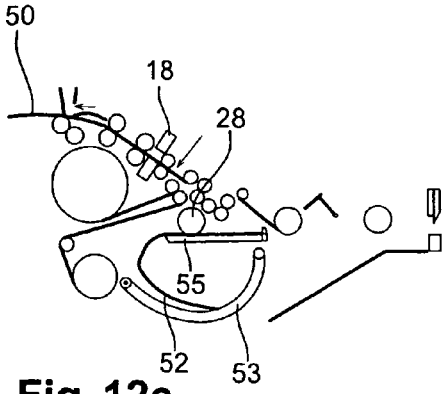
FIGS. 12*a* to 12*f* schematically show the path taken by the sheets of the album apart from the cover sheet after the common steps which are illustrated in FIGS. 10*a* to 10*d*.

The processing of the intermediate sheets, i.e. sheets other than the cover sheet, has been described in relation to FIGS. 12*a* to 12*f*. After the creasing step which has already been described, the intermediate sheet is initially retracted by reversing the direction of rotation of motor 31 and is thus drawn in by two pairs of rollers 14, 15 and 16, 17 respectively, especially in order to ensure the start of the pasting phase (FIG. 12*a*).

According to one embodiment, only half the rear surface or verso of each of the intermediate sheets is pasted apart from the last intermediate sheet which is pasted over its entire verso in order to allow subsequent pasting of the spine of the cover. More especially, only half the upstream area of the verso of each of the sheets in question is actually pasted.

Figure 12B:
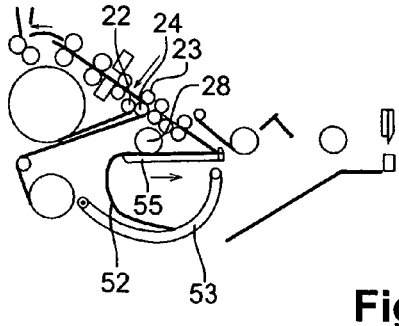

The adhesive application unit is activated in order to achieve this (FIG. 12*b*). The adhesive application unit is described below in relation to FIGS. 6*a*, 6*b* and 6*c* in order to make the operating principle of the adhesive application unit easier to understand.

Basically, pasting in accordance with one embodiment involves coating the dedicated area of the sheets with a transfer adhesive film such as that marketed, for example, by the firm 3M or TESA. This transfer adhesive film is acrylic or vinyl based or based on some other substance for instance. However, acrylic is the most suitable material for obtaining durable bonding of photographic paper.

This adhesive film is stored on a non-adhesive backing made, for example, of paper coated with silicone and this assembly is itself stored on a spool 34 which is rotatably mounted and slightly braked—this is one of the system's consumables. This spool is accommodated in specially provided recesses made in the housing of functional unit 4.

The silicone-coated backing without its adhesive film, i.e. after the pasting operation, is stored on a spool 35 which is also accommodated in specially provided recesses. This spool is rotationally driven by a DC motor which meshes directly with spool 35 thanks to a toothed pinion in order to ensure that the silicone backing can be rewound onto itself. It can also be swung out of the system after use.

Figure 6A:
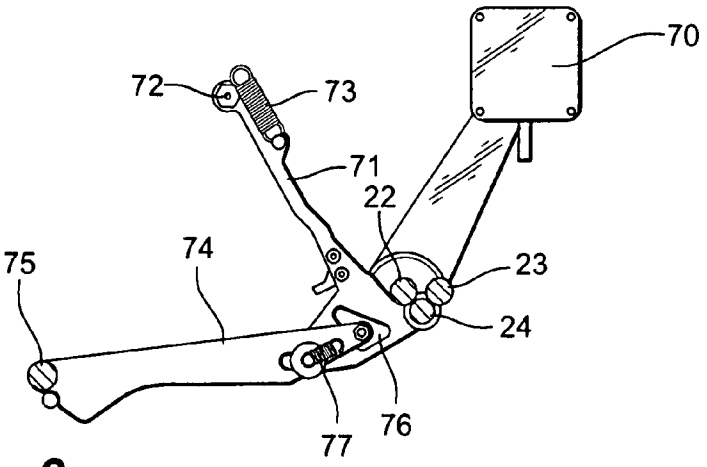
FIGS. 6*a* to 6*c* are schematic views of some of the components of the adhesive application unit in the system in accordance with one embodiment.
Figure 6B:
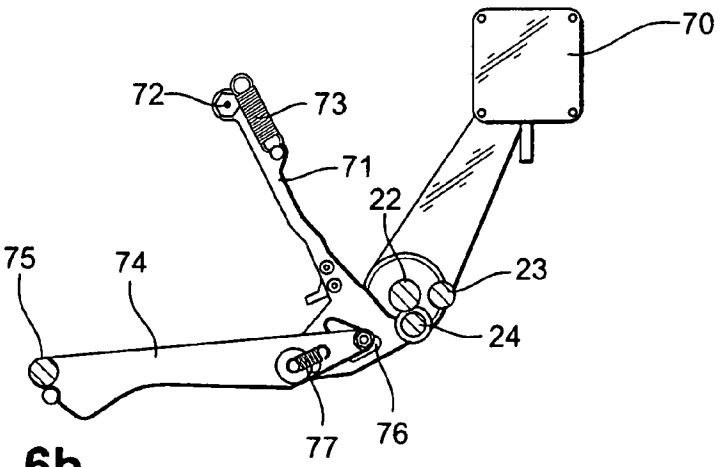
Figure 6C:
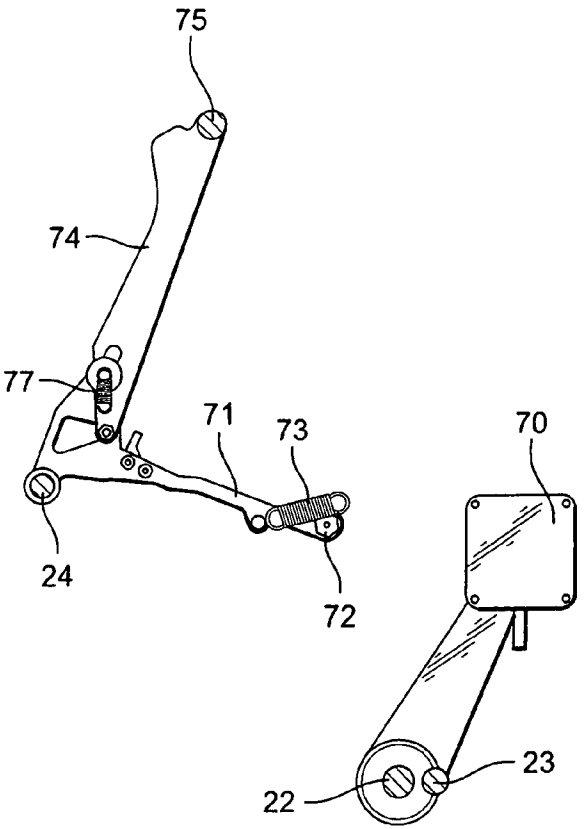

In fact and as apparent, in particular, in FIG. 1, these two spools 34 and 35 are easily accessible once door 2 has been opened and pasting arm 71, 74, 75 has been released and lifted in accordance with FIG. 6*c* in order to facilitate maintenance operations.

The backing complete with adhesive film 36 is drawn in by a motorized roller 22 referred to as the adhesive motor roller. This roller is motor driven by a specific electric motor 70 which is capable of rotating in two directions. Roller 22 which thus ensures unwinding of said backing complete with adhesive film 36 from spool 34 cooperates with a pasting roller 24 which is mounted substantially at the end of a lever 71 articulated at 72 on the housing of functional unit 4, said lever being held in its operational position by a spring 73, whereof one of the application points also consists of the housing (see FIGS. 6*a* and 6*b*).

Said lever 71 is also capable of being partially retracted from its operational position by means of a handle 75 which can also be seen in FIG. 1 and is connected to said lever 71 by cross pieces 74. The assembly comprising lever 71, handle 75 and cross pieces 74 forms the pasting arm mentioned above.

When the maintenance operator wants to replace the pasting consumables, especially spools 34 and 35, he exerts upward pressure and then pulls handle 75, thereby causing lever 71 to rotate around its hinge pin 73 (see FIG. 6*c* which shows the adhesive application unit in its opened position) and this then makes it possible to release the backing of the adhesive film and consequently remove components 34 and 35 in their entirety.

Said pasting roller 24 mounted on the end of lever 71 opposite hinge pin 73 is capable of meshing with motorized pasting roller 22. To achieve this, it is therefore fitted with a toothed wheel which cooperates with a toothed wheel with which roller 22 is equipped—these various components are not shown in order to avoid making the Figures unnecessarily complex.

Pasting roller 24 is mounted on lever 71 as a free wheel. In other words, it is capable of rotating in one direction only and is blocked in the opposite rotation direction. Given this assumption and because it is blocked, it will be subjected to rotation relative to the centre of rotation of motorized pasting roller 22 and therefore around the latter because it meshes with said motorized pasting roller 22. This rotation is made possible, despite the fact that it is fixed on the end of lever 71, by the presence of a slot 76 made in the vicinity of said end which allows lever 71 to swivel despite being locked by handle 75. This is shown in FIG. 6*b* which illustrates the adhesive application unit in its standby position whereas FIG. 6*a* shows the same unit in its actual adhesive application position. When motor 70 starts to turn in the adhesive application direction again, return to the pasting position also takes place thanks to the action of spring 77 which pushes against cross piece 74 which pushes lever 71 forward again.

Finally, the adhesive application unit comprises a roller 23 which acts as a pasting limit stop, i.e. it fulfils a counter pressure function during actual pasting on the sheet in question in response to the positive action of pasting roller 24.

Thus, in FIG. 12*b*, pasting roller 24 is raised and cooperates with pasting limit stop roller 23 between which the area of the sheet in question moves. This being so, pasting roller 24 effectively transfers the adhesive film onto the area in question.

When the upstream area has been pasted in its entirety, the upstream free edge of said sheet presses against limit stops 80 with which delivery board 55 is equipped.

The specific motor 70 of the adhesive application unit is reversed, thereby causing, because of the fact that pasting roller 24 is mounted as a free wheel, rotation of the latter around adhesive motor roller 22 and consequently back-off of the latter (FIG. 12*c*) because this roller also cannot rotate in a backward direction. This being so, a combination of transport of the sheet in question and back-off of this roller causes clean cutting of the adhesive film, thereby avoiding inadvertent deposition of adhesive and the possible detrimental consequences thereof.

Figure 12C:
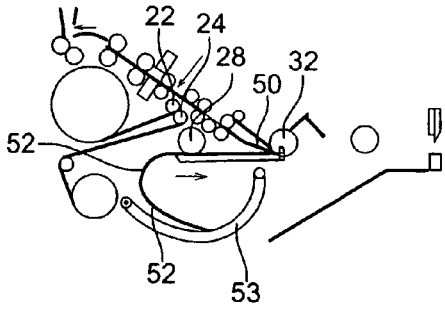
Figure 12D:
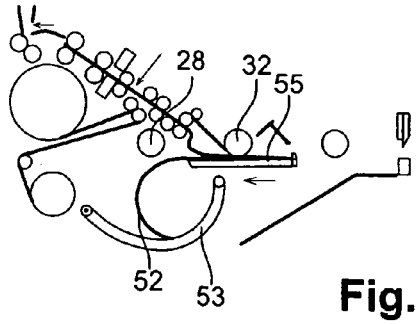

Consequently and as shown in FIGS. 12*b*, 12*c* and 12*d*, delivery board 55 moves towards the front of functional unit 4 and the sheet in question, especially its upstream area which has by then been pasted, is subjected to the action of front presser roll 32 which ensures not only flattening of this upstream area onto the first part of the cover sheet but also actual pasting onto the latter.

Figure 12E:
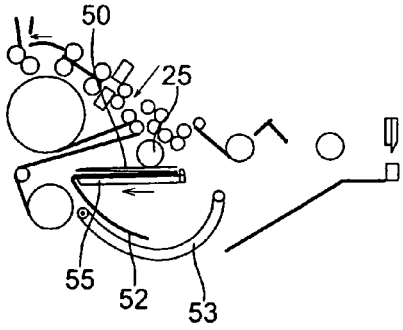
Figure 12F:
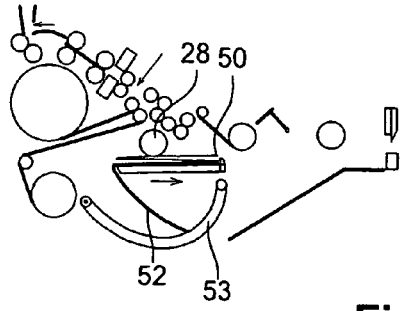

The direction of travel of delivery board 55 is then reversed again and the latter moves back towards the rear of the functional unit so that, due to continued movement of the downstream area of the sheet besides the crease previously made, this causes folding of said sheet, a fold which will be drawn in by rear presser roll 26 as can be seen in FIG. 12*e*.

The reader is reminded that the downstream area of said sheet has not been pasted. Delivery board 55 is backed off until the sheet is released from the features which ensure its transport. The movement of delivery board 55 is then reversed again in order to return it to its position for receiving the subsequent sheet(s) (FIG. 12*f*) which consecutively take the same path.

Figure 13A:
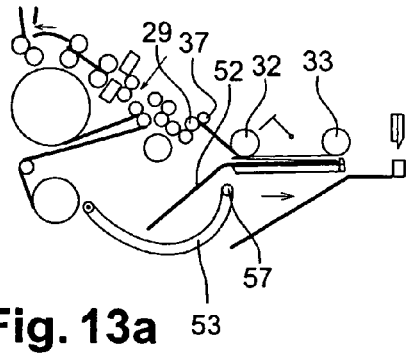
FIGS. 13*a* to 13*e* schematically show the operation in which the spine of the cover is fitted on the stack of sheets produced during the previous steps.
Figure 13B:
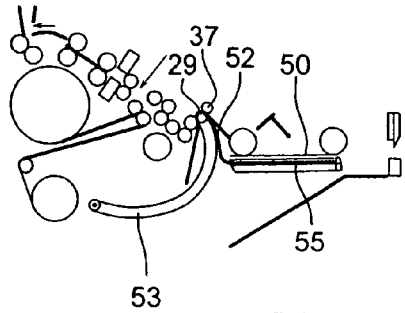

The flap of the cover spine is shown in FIGS. 13*a* to 13*e*. The reader is reminded that said flap is temporarily stored in cover arm 53 (cf. FIGS. 11*a* to 11*d*). Thus, after producing a stack comprising all the intermediate sheets successively positioned and pasted in accordance with FIGS. 12*a* to 12*f*, delivery board 55 is translated towards the front of functional unit 4 in order to make it possible to release rotation of said cover arm 53 and, especially, position it in its upper position (FIG. 13*b*).

Figure 13C:
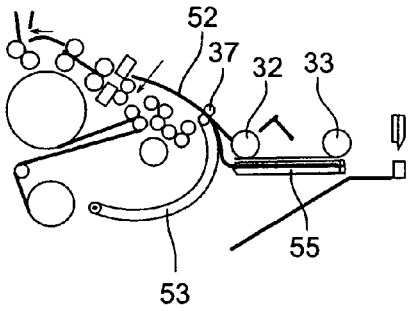
Figure 13D:
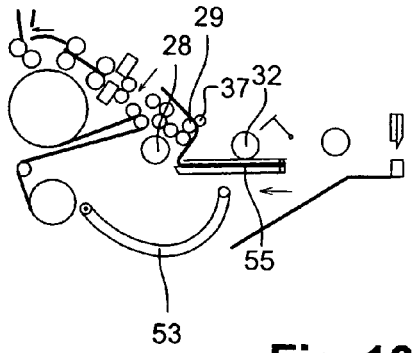

This being so, because of the presence of idler roller 57 on the free end of said cover arm which cooperates with roller 29 and causes the spine of the cover to pass over the various rollers which ensure sheet transport (FIG. 13*b* in the beginning and FIG. 13*c* at the end).

Figure 13E:
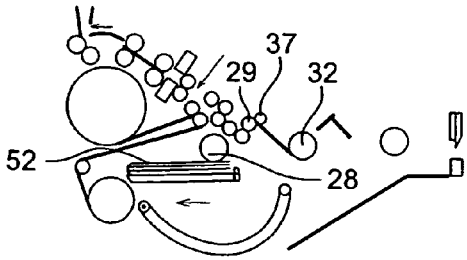

When the entire said cover spine has been turned over, cover arm 53 drops again and this makes it possible to translate delivery board 55 towards the rear of the functional unit again. Because said flap is drawn in by rollers 29 on the one hand and 37 on the other hand, the spine of the cover is tensioned to a certain extent and this subsequently allows rearward movement of said delivery board 55 after having obtained the correct flap on the stack, the flap is then taken in by rear presser roll 28 (FIG. 13*e*).

In the case of this cover-spine flap, the reader is reminded that the entire verso of the previous intermediate sheet has been pasted, unlike the other intermediate sheets, in order to allow effective pasting of said cover spine on it.

The album is therefore thus assembled.

Finishing of the album is described in greater detail in relation to FIGS. 14*a* to 14*e*. According to one aspect, this finishing basically aims to trim said album in order to give the album a neat appearance, notwithstanding accurate positioning of the various sheets which are pushed against limit stops 80 of delivery board 55. In addition, because of the identical format of the cover sheet and the intermediate sheets and because of the fact that said cover sheet ensures the thickness of the album, there is necessarily a mismatch between the free edge of said cover sheet and that of the intermediate sheets and hence the need for such trimming in order to make sure that the free edge of the album is cleanly cut.

Figure 9A:
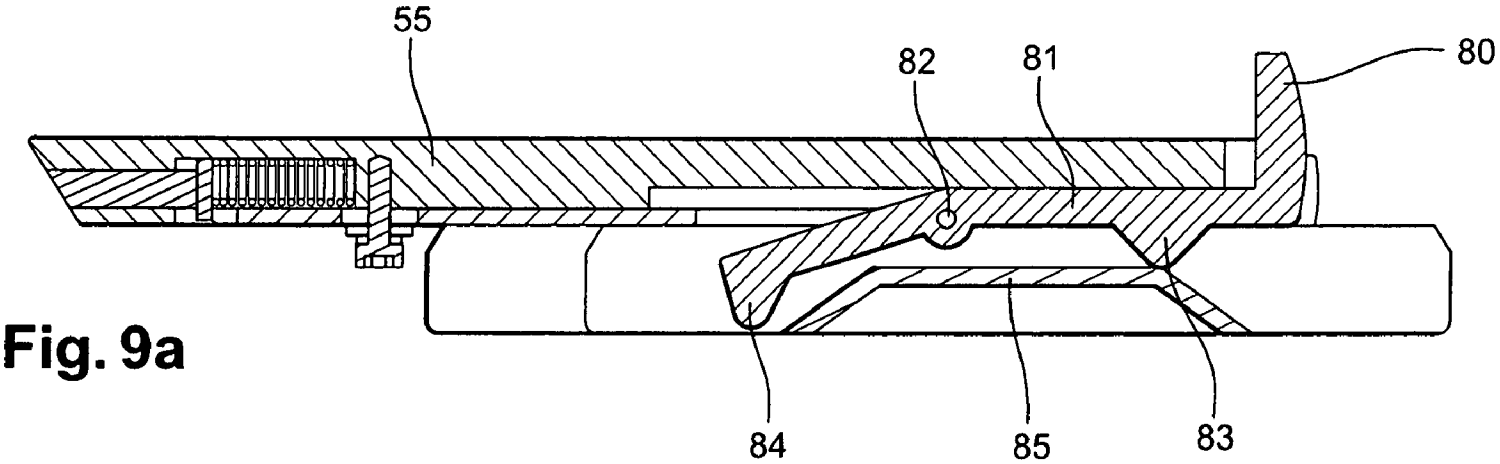
FIGS. 9*a* and 9*b* schematically show the use of the retractable teeth or limit stops of the board described in the previous Figure.
Figure 9B:
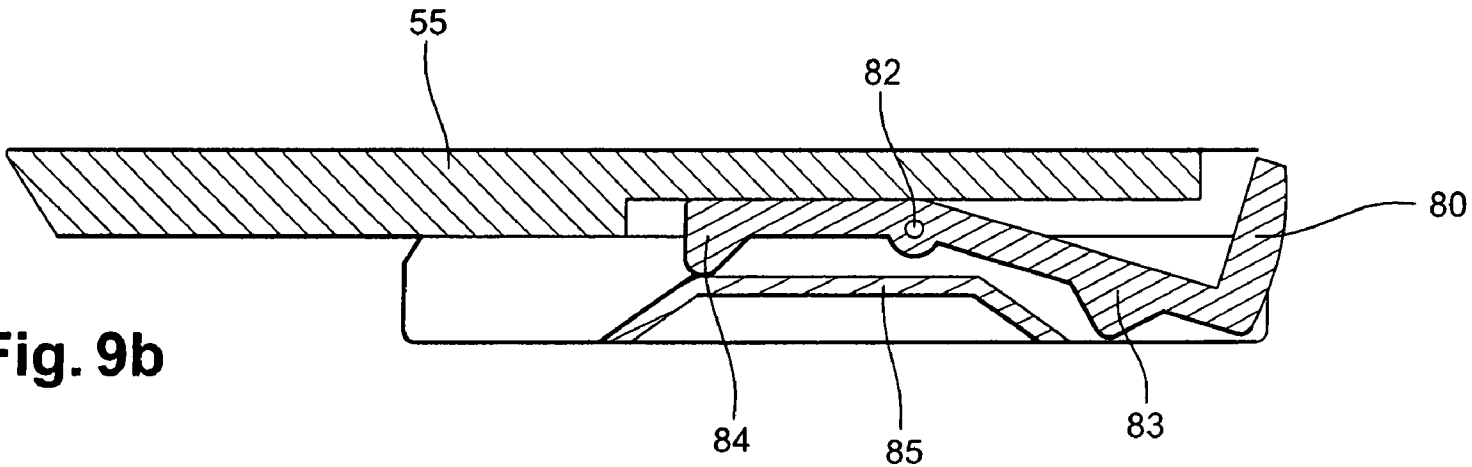
Figure 10A:
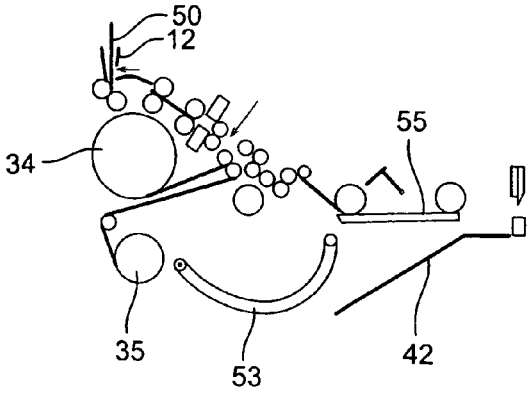
FIGS. 10*a* to 10*d* schematically show the various steps which are common to all the sheets which constitute the album according to one embodiment.
Figure 10B:
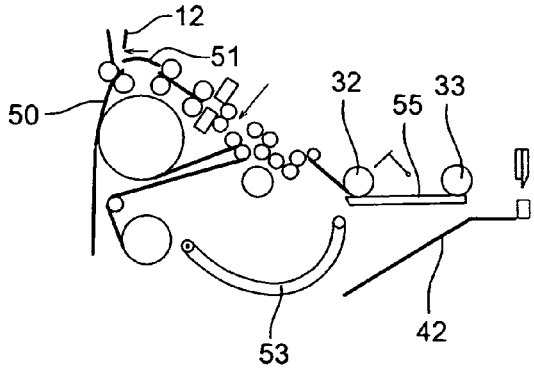
Figure 10C:
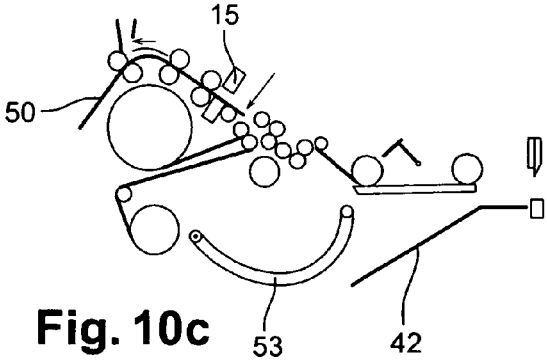
Figure 10D:
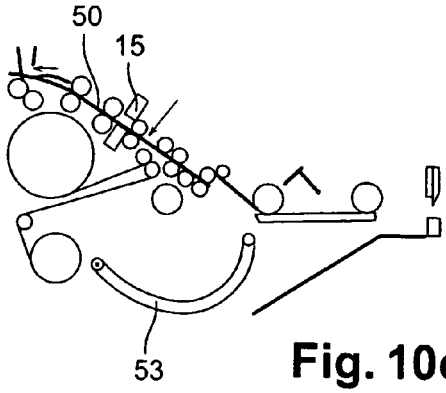
Figure 14A:
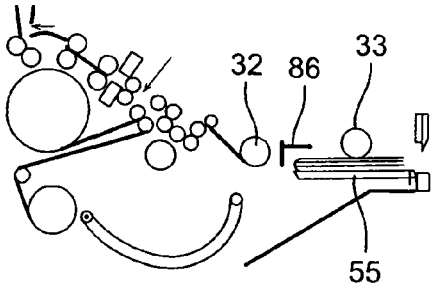
FIGS. 14*a* to 14*e* show the various steps involved in finishing the album in accordance with one embodiment.
Figure 14B:
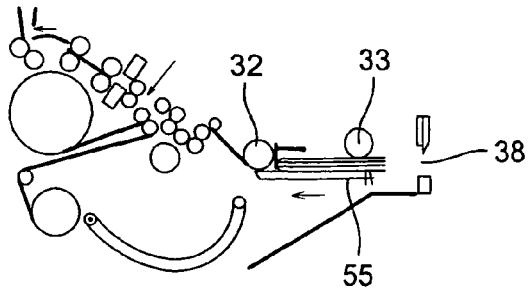
Figure 14C:
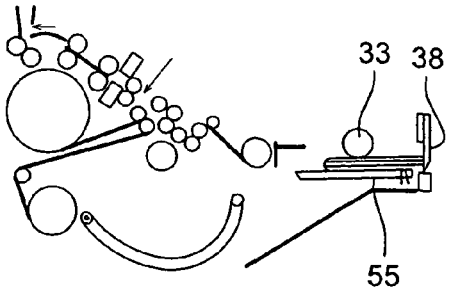
Figure 14D:
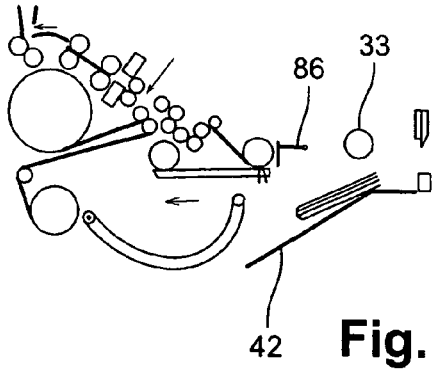
Figure 14E:
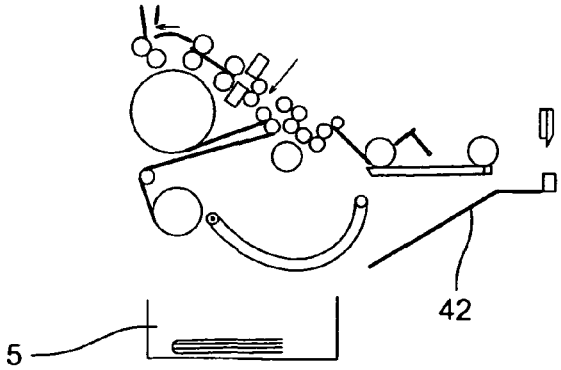

To achieve this, delivery board 55 moves towards the front of functional unit 4 and the album is then drawn in by trimmer presser roll 33, as shown in FIGS. 14*a* and 14*b*. Movement of the board at this level causes retraction of limit stops 80 as apparent in FIGS. 9*a* and 9*b*.

It is apparent that said teeth or limit stops 80 on these are actually mounted at the end of an arm 81 which is itself articulated at 82 underneath said board 55. This arm 81 comprises two downward-facing cams or protrusions, an anterior cam 83 and a posterior cam 84 respectively, which are each designed to cooperate with a cam path 85 associated with board 55 and capable of moving freely translationally relative to the latter.

During all the anterior phases, cam 83 cooperates with the upper flat area of cam path 85, thereby causing limit stops 80 to be positioned in operational mode. In contrast (FIG. 9*b*), when delivery board 55 moves to the anterior position, i.e. during the trimming phase, it is cam 84 which cooperates with cam path 85, thereby causing retraction of teeth or limit stops 80 due to substantially median hinge pin 82.

Consequently, in this area of delivery board 55, a backstop represented by reference 86 and actuated by a cam (not shown) moves downwards.

The direction of movement of delivery board 55 is reversed again, thereby causing backstop 86 to cooperate with the binding or spine of the album thus produced and, consequently, its misalignment from said board in the direction of the forward area of functional unit 4 (in the direction of the straight line in FIG. 14*b*). In other words, because of retraction of limit stops 80 and translational movement of board 55 towards the rear of the functional unit, the album slides over said board and protrudes relative to its upstream edge.

The direction of movement of delivery board 55 is then reversed again in the direction of the functional unit until the area in which a trimmer 38 is actuated is reached. This typically consists of a guillotine blade actuated by a reducer cam capable of exerting a pressure of approximately 400 daN over the cutting length. This guillotine blade therefore ensures clean cutting of the free edge of the produced album with the album being secured during operation of trimmer 38 by trimmer presser roll 33 while delivery board 55 remains static.

After raising the guillotine blade of the trimmer, delivery board 55 retracts but because of the presence of backstop 86, the album then slides off the board and is released and received on sloping ramp 42 in the bottom of functional unit 4, thus allowing said album to be transported towards receptacle 5 by gravity alone.

Figure 8:
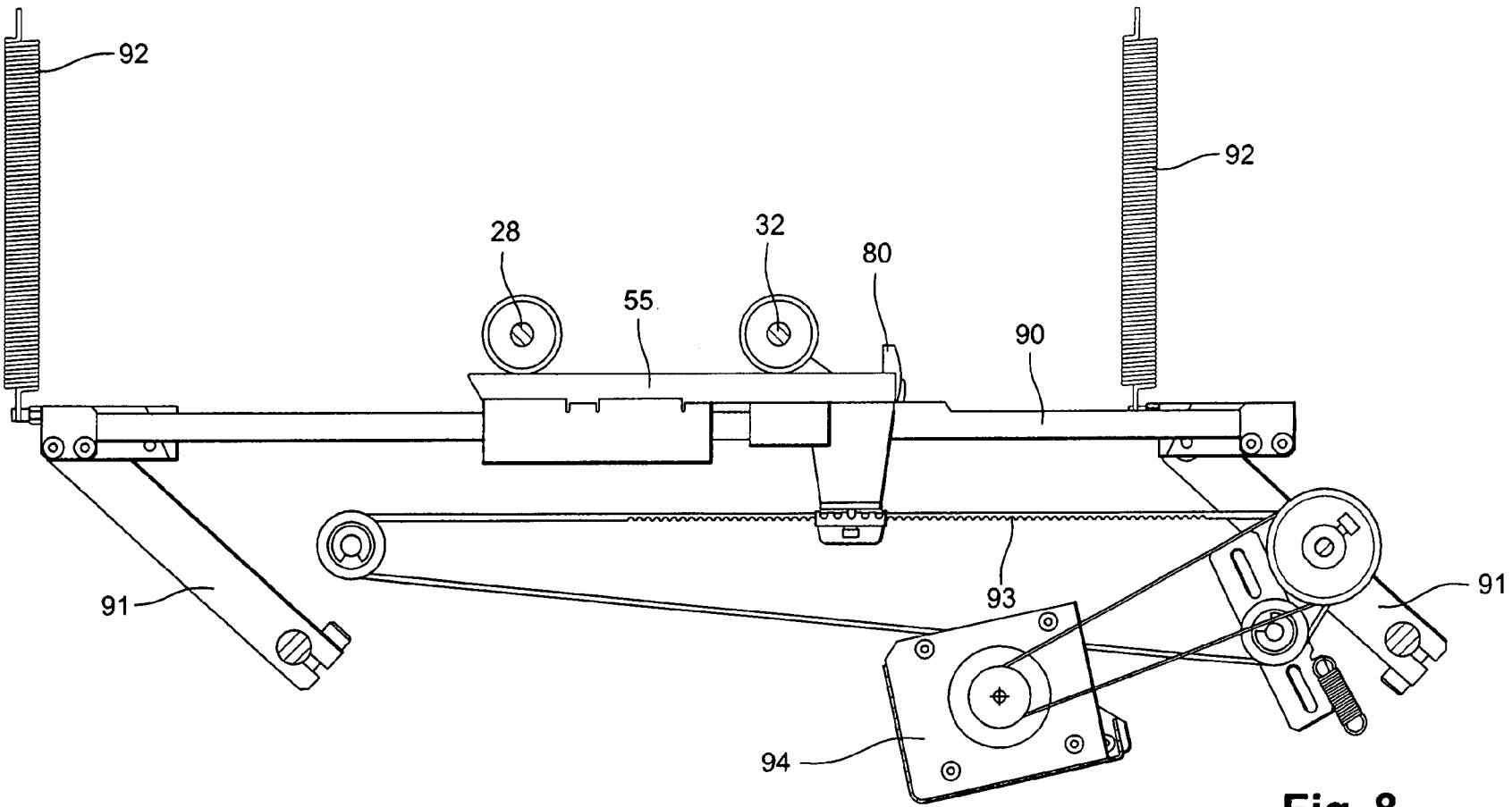
FIG. 8 schematically shows the delivery board of one embodiment and the way it moves.

FIG. 8 shows the general underlying operating principle and, in particular, the movement of delivery board 55 in accordance with the invention. As already stated, the board is fitted on slides or rails 90 which are mounted on swivel arms 91 in a deformable parallelogram configuration. These rails are held in an upper position by springs 92 whereof one of the application points is attached to the housing of functional unit 4 so that, because of cooperation between board 55 and various presser rolls, in particular front and rear rolls 28 and 32, pressure is always exerted on the last sheet deposited and it is kept at the same height, this height being determined by the bottom of rolls 28 and 32.

This board is connected to toothed belt 93 which is translationally actuated in two directions by dedicated electric motor 94.

Because of the particular processing of the cover, it is possible to reduce the length of the board significantly compared with the device according to the prior art described above. This has advantages in terms of compactness and the overall dimensions.

The system in accordance with the invention makes it possible to produce photo albums of varying thicknesses of up to 20 sheets or 40 pages.

Advantageously, the entire system is controlled by a programmable logic controller or a PC or logic circuitry which, in particular, ensures activation of the various motors and processing of the signals transmitted by the sensors.

It is therefore fully automated because both trimming and ejection of the album produced require no operator intervention whatsoever.

What is claimed is:

1. A system for automatically producing a bound album consisting of individual sheets, the individual sheets including intermediate sheets and a cover sheet, comprising:

a unit which immediately draws in sheets output by a printer or a stacker;

a unit for creasing said sheets so as to facilitate folding them and keeping said individual sheets in their folded form;

an adhesive application unit for pasting at least some of the individual sheets two by two; and a unit for flipping part of the cover sheet over the intermediate sheets;

said individual sheets being received and compiled on a delivery board equipped with registration features for this purpose, said board being capable of translational movement in a direction substantially parallel to the direction in which the sheets are transported inside the system and moving between several positions in synchronism with the adhesive application unit, wherein the unit for flipping the cover sheet comprises a substantially curved arm which is articulated on a housing of the system and designed to move between at least two extreme positions respectively, a lower or bottom position suitable for receiving the upstream part of the cover sheet and an upper or top position intended to cause, in particular, folding of the upstream part of the cover sheet over the other intermediate sheets, said articulated arm being moved between its two extreme positions by means of a motorized cam, and the end of said articulated arm opposite to its hinge pin having an idler roller capable of cooperating with some of rollers which transport the sheets inside the system.

2. A system for automatically producing a bound album consisting of individual sheets, the individual sheets including intermediate sheets and a cover sheet, comprising:

a unit which immediately draws in sheets output by a printer or a stacker;

a unit for creasing said sheets so as to facilitate folding them and keeping said individual sheets in their folded form;

an adhesive application unit for pasting at least some of the individual sheets two by two; and a unit for flipping part of the cover sheet over the intermediate sheets;

said individual sheets being received and compiled on a delivery board equipped with registration features for this purpose, said board being capable of translational movement in a direction substantially parallel to the direction in which the sheets are transported inside the system and moving between several positions in synchronism with the adhesive application unit, wherein the delivery board is provided with teeth or limit stops which constitute said registration features and project relative to the plane in which the sheets are received and on which the free edge of the sheets rests in order to provide a reference for compiling and stacking, said teeth or limit stops being mounted on an arm articulated underneath said board equipped with a cam at each of its ends, said cams cooperating with a cam path associated with the board which are capable of free translational movement relative to the latter in order to cause retraction or, on the contrary, ejection of said teeth or limit stops on the board.

3. A system for automatically producing a bound album consisting of individual sheets as claimed in claim 1, wherein it also comprises a trimmer ensuring clean cutting of the free edges of the sheets which make up the album after the latter has been produced, said album being transferred at the level of the operational area of said trimmer by the delivery board.

4. A system for automatically producing a bound album consisting of individual sheets as claimed in claim 1, wherein the delivery board is fitted on height-adjustable guide rails which are mounted for this purpose on cross pieces which are articulated on a housing of the system in order to keep the height of the upper sheet of the album which is being made up and resting on said board substantially constant regardless of the number of sheets which the album comprises, said rails being fitted for this purpose with an elastic return mechanism connected to the housing and causing the board to be pulled back against the limit stops consisting of at least one presser roll.

5. A system for automatically producing a bound album consisting of individual sheets as claimed in claim 3, wherein it comprises a backstop actuated by a cam and capable of cooperating with the album after its completion when the latter is still located on the delivery board in order to cause, firstly, movement of said album partially off said board in the direction of trimmer and allow operation of the latter and, secondly, after this operation, removal of said album from the delivery board and dropping of said album into a receptacle provided for this purpose by gravity alone.

6. A system for automatically producing a bound album consisting of individual sheets, the individual sheets including intermediate sheets and a cover sheet, comprising:

a unit which immediately draws in sheets output by a printer or a stacker;

a unit for creasing said sheets so as to facilitate folding them and keeping said individual sheets in their folded form;

an adhesive application unit for pasting at least some of the individual sheets two by two; and a unit for flipping part of the cover sheet over the intermediate sheets;

said individual sheets being received and compiled on a delivery board equipped with registration features for this purpose, said board being capable of translational movement in a direction substantially parallel to the direction in which the sheets are transported inside the system and moving between several positions in synchronism with the adhesive application unit, wherein the creasing unit comprises a punch and a die between which the sheets are capable of passing one by one, except during the actual creasing step itself, said punch being mounted on the end of an articulated arm which is moved by a cam.

7. A system for automatically producing a bound album consisting of individual sheets as claimed in claim 6, wherein the die is fitted with a movable pressure pad suitable for facilitating ejection of the fold of the sheet made in its body as a result of the action of the punch and preventing said sheet from catching against the edge of the slit of the die when the sheet in question starts moving again.

8. A system for automatically producing a bound album consisting of individual sheets, the individual sheets including intermediate sheets and a cover sheet, comprising:

a unit which immediately draws in sheets output by a printer or a stacker;

a unit for creasing said sheets so as to facilitate folding them and keeping said individual sheets in their folded form;

an adhesive application unit for pasting at least some of the individual sheets two by two; and a unit for flipping part of the cover sheet over the intermediate sheets;

said individual sheets being received and compiled on a delivery board equipped with registration features for this purpose, said board being capable of translational movement in a direction substantially parallel to the direction in which the sheets are transported inside the system and moving between several positions in synchronism with the adhesive application unit, wherein the adhesive application unit comprises:

a storage spool for a backing covered in a film of transfer adhesive;

a storage spool for the backing alone after depositing said transfer adhesive;

an adhesive motor roller driven by a specific motor capable of rotating in two directions which ensures unwinding of said backing complete with its adhesive film;

a pasting roller designed to come into contact with the sheet or part of a sheet to be pasted and cooperating with the adhesive motor roller by meshing with the latter, said pasting roller being rotatably mounted, i.e. capable of rotating freely in only one direction, at the end of a lever which is articulated on a housing of the system and held in its operational adhesive application position by a spring attached to said housing;

a pasting contact roller which counteracts the action of the pasting roller during actual pasting phases, and a handle connected to said lever and capable of producing at least partial retraction of the active pasting components consisting of various rollers in order, in particular, to make it possible to perform the maintenance operations required by this unit.

9. A system for automatically producing a bound album consisting of individual sheets as claimed in claim 4, wherein it comprises a backstop actuated by a cam and capable of cooperating with the album after its completion when the latter is still located on the delivery board in order to cause, firstly, movement of said album partially off said board in the direction of trimmer and allow operation of the latter and, secondly, after this operation, removal of said album from the delivery board and dropping of said album into a receptacle provided for this purpose by gravity alone.

* * * * *